United States Patent [19]

Poncy et al.

[11] Patent Number: 4,690,457

[45] Date of Patent: Sep. 1, 1987

[54] CHAIR WITH LIFT ASSISTANCE MECHANISM

[75] Inventors: Richard P. Poncy, Palm Beach Gardens; Mathew Chrzanowski, West Palm Beach, both of Fla.

[73] Assignee: Steridyne Corporation, Riviera Beach, Fla.

[21] Appl. No.: 880,928

[22] Filed: Jul. 1, 1986

[51] Int. Cl.[4] ..... A47C 1/02

[52] U.S. Cl. ..... 297/337; 297/DIG. 10

[58] Field of Search ..... 297/337, 339, DIG. 10; 4/251

[56] References Cited

U.S. PATENT DOCUMENTS 4,538,853 9/1985 Levenberg ..... 297/337 X 4,581,778 4/1986 Pontoppidan ..... 4/251

FOREIGN PATENT DOCUMENTS 2625046 12/1977 Fed. Rep. of Germany ... 297/DIG. 10

2109676 6/1983 United Kingdom ..... 297/DIG. 10

*Primary Examiner*—James T. McCall

*Attorney, Agent, or Firm*—Lane and Aitken

[57] ABSTRACT

In a lift chair designed to assist individuals in rising from a seated position, a seat has a front portion pivotally attached to the chair frame, and a pneumatic cylinder pivotally connected between a central vertical frame member below the front portion of the seat and the seat. The positions of the connection of the ends of the pneumatic cylinder to the frame and to the seat is selectable to control the lifting force provided by the cylinder.

6 Claims, 6 Drawing Figures

CHAIR WITH LIFT ASSISTANCE MECHANISM

BACKGROUND OF THE INVENTION

The present invention relates to lift chairs used to assist invalids in rising from the seated position.

DISCUSSION OF RELATED ART

Persons whose medical condition makes movement difficult for them often find the movement required to arise from a seated position particularly difficult. Chairs with motor-driven seat cushions that are pivoted so as to thrust the seated occupant up and forward, out of the chair, are well known. However the weight of these units and the power cord connection they require make them awkward to move and limited in their usefulness. They also tend to be prohibitively expensive to buy and to maintain, for many such persons.

Lift chairs having a seat that is lifted by multiple resilient pneumatic struts are known. The lift force provided by such chairs is increased by adding extra struts to the chair. However, this requires that a supply of such struts be kept on hand. Also, this increases the weight and cost of the chair while providing only a limited and very discontinuous adjustability and, therefore, only very minimal control of the lifting operation, which makes it potentially hazardous.

SUMMARY OF THE INVENTION

A lift chair in accordance with the present invention provides a safe, low-cost, lightweight, fully adjustable lift chair. The lift chair comprises a chair frame, a seat having a front portion of said seat pivotably attached to the chair frame, and a resilient compression cylinder pivotably connected between a central vertical frame member below said front portion of the seat and the seat. The position of the connection of first and second ends of the cylinder to the seat and to the chair frame is selectable to control the lifting force provided by the cylinder and the pivoting of the seat.

BRIEF DESCRIPTION OF THE DRAWINGS

The features and advantages of the present invention will be better understood when the following detailed description of the preferred embodiment is considered in conjunction with the drawing provided in which.

In the figures like parts have the same reference number.

DETAILED DESCRIPTION OF THE PREFERRED EMBODIMENT

Figure 1:
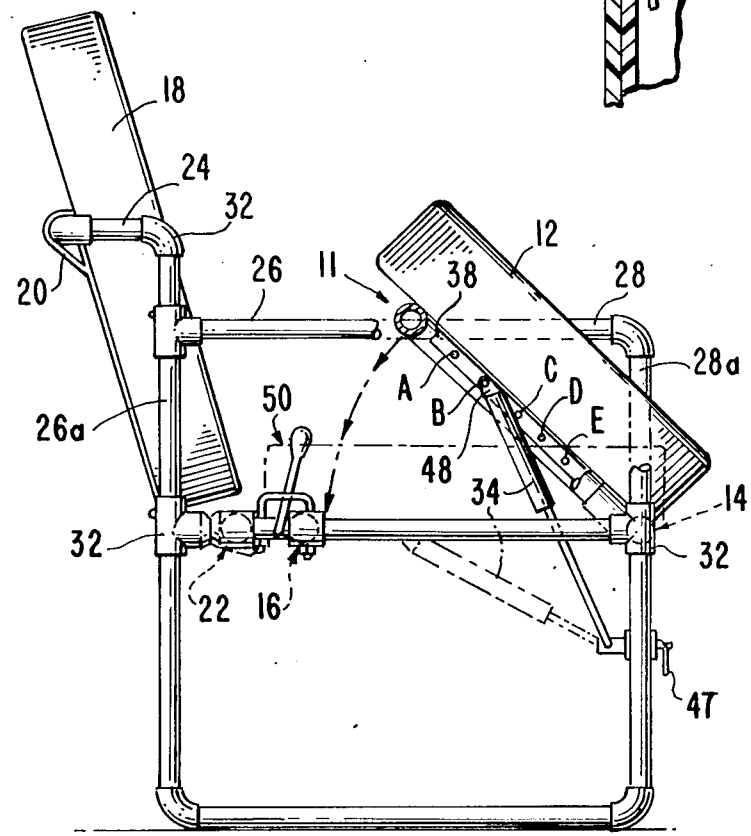
FIG. 1 is a side view of the chair with its seat in the raised position, with the fully lowered position shown in phantom.

With reference to FIG. 1, the preferred embodiment of the lift chair comprises a jointed tubular chair frame

10 of furniture grade polyvinyl-chloride plastic. A seat frame 11 having a cushion 12 is hinged to a front seat cross member 14. The rear edge of the frame 11 is supported by a middle seat cross member 16 when the frame and cushion are in their lower position. The back cushion 18 is supported by a vinyl sling 20. The lower end of the vinyl sling is looped around a rear seat cross member 22 and its upper end loops around a U-shaped back support cross member 24. The middle of the rear seat cross member 22 is connected to the middle of the middle seat cross member 16 by T-joints 23 and 25 and a connecting post 27. Both the seat and back cushions are vinyl-covered for easy maintenance and the seat cushion is an antidecubitus cushion, which contains a gel filled bladder and which reduces the discomfort sometimes caused by prolonged periods of sitting. On the bottom side of the cushion is a mounting board 17, to which the vinyl cover is stapled on the underside of the cushion.

Figure 2:
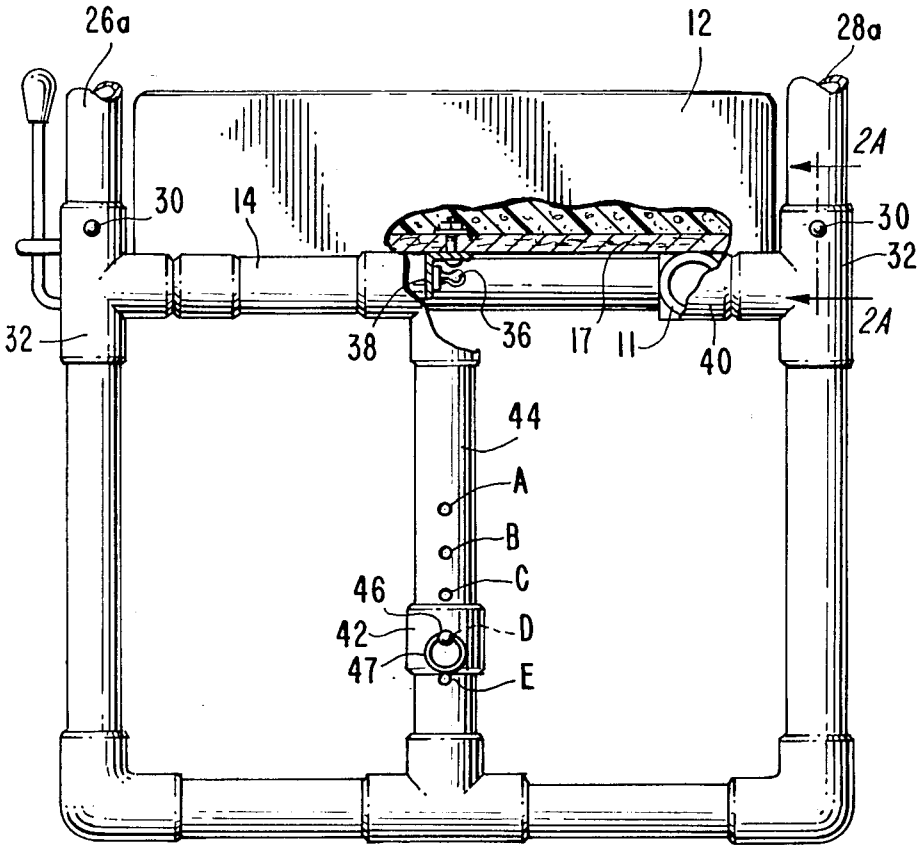
FIG. 2 is a front view of the lower front portion of the chair with the seat cushion cut away to show one of the ball studs on the angle bracket.
Figure 2A:
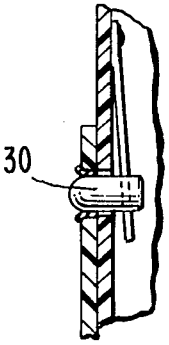
FIG. 2*a* is a cross section detail view taken along line 2*a* in FIG. 2.

The back support member 24 and side support members 26, 28 which provide arm rests on each side of the chair, are releasably held in place by spring-loaded latch buttons 30, shown in FIG. 2A, in the T-elbows 32 connecting the back support 24 to the side supports 26 and 28 and connecting the vertical posts 26*a* and 28*a* of the side supports 26 and 28 to the lateral seat support members. With the back and side supports removed, the chair can be readily transported by car. The chair is also more space-efficient for storage when these supports are thus separated from the seat platform.

The seat frame 11 is raised by a pneumatic cylinder 34. One end of the cylinder is connected to a ball stud 36 on right angle bracket 38 attached to the underside of the mounting board 17 normal to the frond seat support cross member 14 which is attached to the seat frame 11 by hinges 40. The other end of the cylinder 34 is attached to the underside of the mounting board 17 normal to the front seat support cross member 14 which is attached to the seat frame 11 by hinges 40. The other end of the cylinder 34 is attached to a collar 42 around a central frame member in the form of a vertical brace 44 in the lower front portion of the frame 10, as shown in FIG. 2. The collar 42 is releasably held at a given place along the brace 44 by a lock pin 46 which terminates in a pull ring 47 on one end to facilitate its removal from the collar 42. With the lock pin 46 removed from the collar 42 the collar can be slid along the brace 44 to any of a plurality of positions indicated by holes labelled A–E into which the lock pin 46 can be inserted.

Similarly, the right angle bracket 38 carries a plurality of ball studs 36 labelled A–E. The pneumatic cylinder 34 can be mounted on any one of those ball studs by slipping a socket 48 on the free, upper end of the cylinder over the ball stud 36 and then adjusting the end of the cylinder that is attached to the collar 42 to a corresponding position (A–E) along the brace 44. The further toward the front of the seat 12 that the socket 48 is connected, the shorter the length of the lever between the cylinder and the hinge point 40 of the seat frame 11; therefore, the further back along the bracket 38 that the socket 48 is connected, the heavier the load that the cylinder 34 can raise. The position of the collar 42 along the central vertical brace 44 determines how high the seat cushion 12 will be raised when the cylinder 34 is in its fully extended position.

Figure 3:
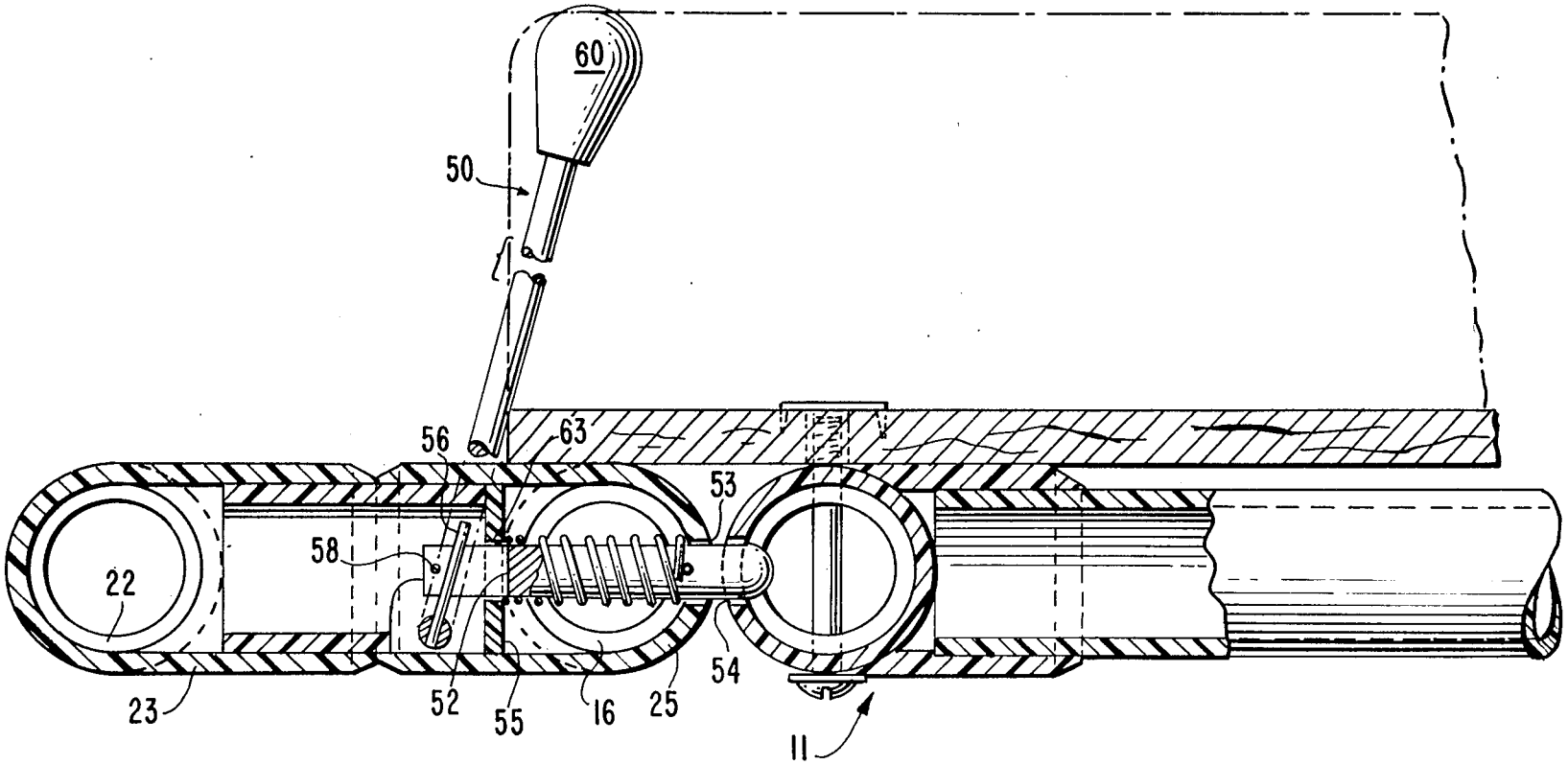
FIG. 3 is a side view showing the lock and pin in cross section.
Figure 4:
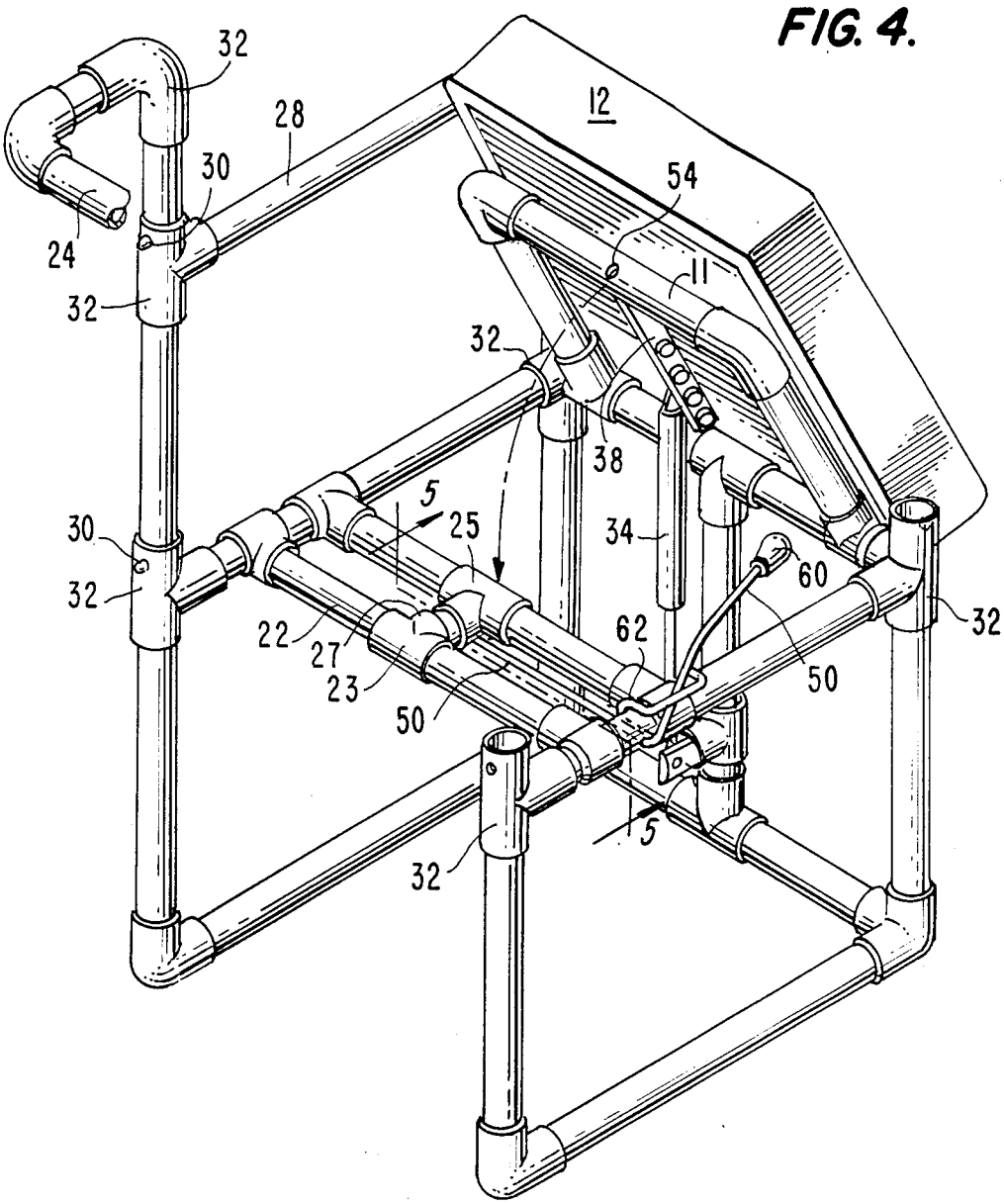
FIG. 4 is a perspective view of the frame members under the seat cushion.

The movement of the seat cushion 12 is controlled by a control lever 50 which releases the seat frame 11 from its horizontal position. A lock pin 52 is slidably mounted in the center of the middle seat support cross member 16, as shown in FIG. 3. The front end of the pin 52 is a slidably supported in an aperture 53 in the front side of the T-joint 25 and the back end of the pin 52 is slidably supported in an aperture 63 in a disc 55 mounted in the rearwardly extending leg of the T-joint 25. A spring 57 surrounding the lock pin 52 biases the pin 52 forwardly by being compressed between the disc 55 and a stop pin 59 mounted transversely in the lock pin 52. The expansion of the spring 57 is limited by the distance between the disc 55 and the front wall of the T-joint 25 around the aperture 53. When the seat frame 11 is in its lowered position, a rounded end of the spring-loaded lock pin 52 engages a hole 54 in the seat frame 11 to prevent untimely lifting of the seat cushion 12. The rear end of the lock pin 52 is formed with a vertical slot 61. A retractor pin 58 mounted in the rear end of the lock pin 52 and extends across the vertical slot 61. A cramming pin 56 inserted in the control lever 50 extends through the slot 61 and pushes against retractor pin 58 to move the lock pin 52 back, out of engagement with the seat frame 11 when the control lever 50 is rotated towards the rear of the seat 12.

The position (A–E) of the socket 38 on the pneumatic cylinder 34 and the collar 42 on the brace 44 should be adjusted such that, after the spring-loaded lock pin is retracted, the seat will begin to rise when the control lever 50 releases the seat cushion 12 and the weight of the particular patient who occupies the chair is shifted toward the front of the chair. When the center of gravity of the chair's occupant shifts back toward the rear of the chair, the seat cushion will move back into its locked position as the curved surface of the seat frame 11 forces the rounded end of the locking pin 52 back inside the middle support cross member 16 until the seat is fully lowered at which time the spring loaded locking pin 52 is inserted in the hole 54 in the seat frame 11 once again. When the cylinder 34 is properly adjusted in the correct selected position A through E, its lifting force will approximately balance the weight of the seated person so that lifting can be effected by the seated person inclining only his head and shoulders forward and lowering can be effected by the person lifting his head and shoulders to an erect position.

Figure 5:
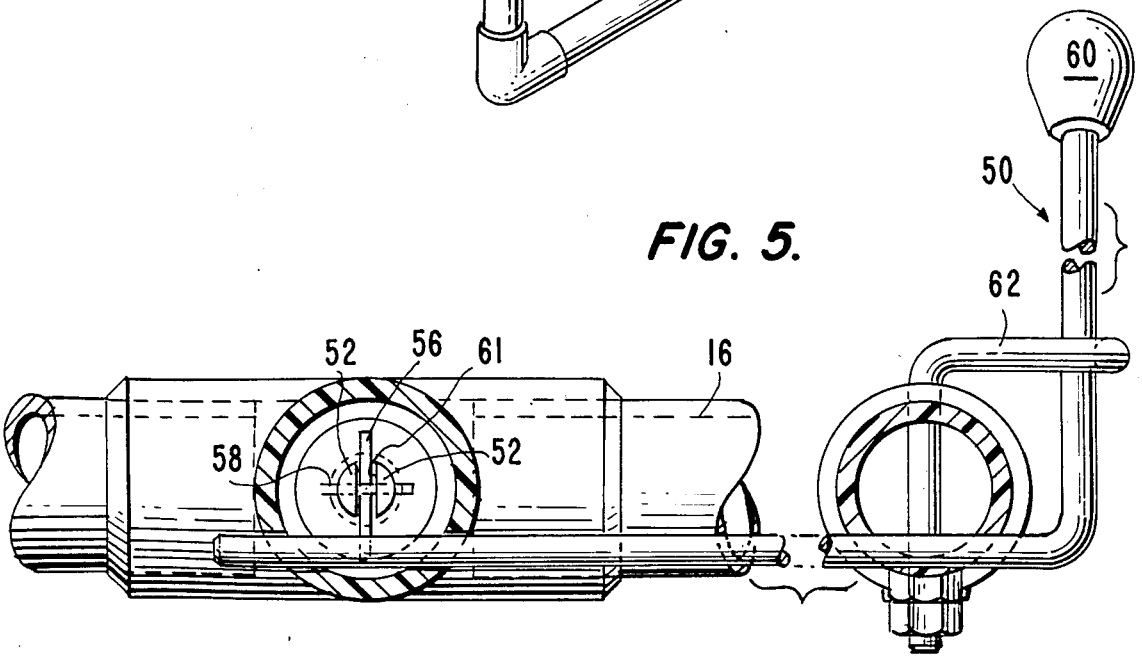
FIG. 5 is a rear view cross section showing the relation between the retractor pin and the lever pin and the control handle and its restraint bracket.

The end of the control lever 50 carrying the handle 60 is resiliently biased inward toward the chair by retainer bracket 62. The retainer bracket provides friction which keeps the handle in place when the seat is lowered, and limits the front-to-back rotation of the handle 60 to keep it in a convenient, upright position, as shown in FIG. 5. During the lowering of the seat and engagement of the seat frame 11 by the spring-loaded locking pin 52 the handle 60 on the control lever 50 remains in its forward position because the cotrol lever 50 is maintained stationary on the retainer bracket 62. This feature avoids potential injury to the user of the chair by movement of the handle 60 when the user is being seated. When the lock pin is fully extended forward, in the locked position of seat frame 11, the control lever 50 is spring-loaded forward by the spring loading of the lock pin 52.

The foregoing describes a preferred embodiment of the invention, and variations and modifications thereof may be made without departing from the spirit and scope of the invention, which is defined in the appended claims.

What is claimed is:

1. A lift chair comprising:

a seat;

a frame supporting said seat and to which a front portion of said seat is pivotably attached, said frame having a central vertical frame member below said front portion of said seat;

a resilient compression cylinder having a first and second ends; and means for selectably pivotably connecting said ends of said cylinder in a plurality of positions on said seat and said central vertical frame member of the chair frame, respectively, whereby the lifting force applied to said seat and the pivotal movement of said seat provided thereby are controlled.

2. The lift chair as claimed in claim 1 further comprising a spring-loaded lock pin on said frame for engaging said seat to prevent untimely lifting of said seat and a control lever for selectively releasing said lock pin when a lift is desired.

3. The lift chair as claimed in claim 1 wherein said frame comprises a selectably removeable back support member and side support members that are releasably attached to the rest of said frame for convenient storage and transportation of the chair.

4. Apparatus as claimed in claim 1 wherein an end of said cylinder is attached to a sliding means for sliding said end between said respective positions on said central vertical frame member and a lock pin that selectably fixes said sliding means in said respective positions.

5. Apparatus as claimed in claim 1 wherein an end of said cylinder is selectably connected in said respective positions by a ball and socket connector assembly.

6. A lift chair comprising a seat, a frame supporting said seat onto which a front portion of said seat is pivotally attached, a resilient compression cylinder having first and second ends, means for selectively pivotally connecting one end of said cylinder in a plurality of positions on said seat, and means for selectively, pivotally connecting the other end of said cylinder at a plurality of vertically spaced positions under the pivotal attachment of said seat to said frame.

* * * * *